US009193563B2

(12) United States Patent
Arnold et al.

(10) Patent No.: US 9,193,563 B2
(45) Date of Patent: Nov. 24, 2015

(54) ELEVATOR SYSTEM FLOOR POSITION DETECTION DEVICE

(75) Inventors: Daniel Arnold, Fluelen (CH); Eric Birrer, Buchrain (CH)

(73) Assignee: Inventio AG, Hergiswil (CH)

( * ) Notice: Subject to any disclaimer, the term of this patent is extended or adjusted under 35 U.S.C. 154(b) by 745 days.

(21) Appl. No.: 13/518,074

(22) PCT Filed: Dec. 1, 2010

(86) PCT No.: PCT/EP2010/068599

§ 371 (c)(1), (2), (4) Date: Aug. 27, 2012

(87) PCT Pub. No.: WO2011/076533

PCT Pub. Date: Jun. 30, 2011

(65) Prior Publication Data

US 2012/0312639 A1 Dec. 13, 2012

(30) Foreign Application Priority Data

Dec. 21, 2009 (EP) ..... 09180114

(51) Int. Cl.
*B66B 1/34* (2006.01)
*B66B 1/50* (2006.01)

(52) U.S. Cl.
CPC ..... *B66B 1/50* (2013.01); *B66B 1/3492* (2013.01)

(58) Field of Classification Search
CPC ..... B66B 1/50; B66B 1/3492
USPC ..... 187/283, 291, 391, 393, 394, 247, 282
See application file for complete search history.

(56) References Cited

U.S. PATENT DOCUMENTS

| | | | | | |
|---|---|---|---|---|---|
| 1,561,232 | A * | 11/1925 | Higbee | 187/284 |
| 3,048,818 | A * | 8/1962 | Burckhardt et al. | 187/394 |
| 5,509,505 | A * | 4/1996 | Steger et al. | 187/394 |
| 5,783,783 | A * | 7/1998 | Toutaoui et al. | 187/394 |
| 5,831,227 | A * | 11/1998 | Finn et al. | 187/394 |
| 7,441,631 | B2 * | 10/2008 | Oh et al. | 187/394 |
| 7,731,000 | B2 * | 6/2010 | Oh et al. | 187/394 |
| 2004/0216962 | A1 * | 11/2004 | Kunz et al. | 187/394 |
| 2007/0227831 | A1 * | 10/2007 | Zaharia | 187/394 |
| 2011/0114425 | A1 * | 5/2011 | Meri et al. | 187/394 |
| 2012/0193171 | A1 * | 8/2012 | Kangas | 187/287 |
| 2014/0182978 | A1 * | 7/2014 | Bunter | 187/394 |

FOREIGN PATENT DOCUMENTS

| | | | |
|---|---|---|---|
| EP | 0847953 | A1 | 6/1998 |
| FI | 120 449 | B1 | 10/2009 |
| WO | 03/011733 | A1 | 2/2003 |

* cited by examiner

*Primary Examiner* — Anthony Salata
(74) *Attorney, Agent, or Firm* — Fraser Clemens Martin & Miller LLC; William J. Clemens

(57) ABSTRACT

A floor position detection device of an elevator system includes a first sensor unit having a first Hall sensor and which is provided to detect at least one floor position characteristic, and an evaluation unit which is provided to evaluate the floor position characteristic for generating a floor signal. The sensor unit includes a second Hall sensor and the evaluation unit evaluates at least two floor position characteristics for generating the floor signal.

12 Claims, 3 Drawing Sheets

12 elevator car
18, 20 sensor unit
50, 52 evaluating unit
58, 60 synchronizing unit
72 absolute position system
74 control unit 12 elevator car
18, 20 sensor unit
50, 52 evaluating unit
58, 60 synchronizing unit
72 absolute position system
74 control unit 40, 42, 44, 46, 48 Hall sensor
78 electronic circuit
84 electronic comparator circuit
92 comparator circuit
98 logic circuit
102, 104 D-flip-flop

ELEVATOR SYSTEM FLOOR POSITION DETECTION DEVICE

FIELD

The invention relates in particular to a floor position detection device of an elevator system.

BACKGROUND

A device is known from the publication EP 0847953 A1, by means of which device it can be detected when an elevator car has arrived at a floor. The device comprises two permanent magnets in an identical alignment, which magnets are arranged at a site that characterizes the floor, a magnetic field sensor for sensing the magnetic field generated by the permanent magnets and also an evaluating unit for evaluating a signal from the magnetic field sensor.

SUMMARY

An object of the invention is, in particular, to provide a simple and cost-effective device for reliably detecting a position of a floor of an elevator system.

The invention relates to a floor position detection device of an elevator system having at least a first sensor unit that comprises a first Hall sensor and that is provided for the purpose of sensing at least one floor position characteristic, and having an evaluating unit that is provided for the purpose of evaluating the floor position characteristic in order to generate a floor signal.

It is proposed that the sensor unit comprises at least a second Hall sensor and the evaluating unit that is provided for the purpose of evaluating at least two floor position characteristics in order to generate the floor signal. By involving at least a second Hall sensor, a simple and cost-effective solution to reliably sensing the floor position characteristic is achieved. The term "floor position characteristic" is understood to mean in this context, in particular, the signal from a Hall sensor on the basis of a magnetic means, which magnetic means is attached at a site that characterizes the position of the floor. The term "floor signal" is understood to mean in this context an electrical or electronic signal, in particular a trigger signal that is provided for the purpose of indicating that a defined relative position has been achieved between an elevator car and the floor. The term "evaluating unit" is understood to mean in this context, in particular, an electronic unit for processing analog and/or digital electrical signals. The term "provided for the purpose of" is understood to mean in this context, in particular, especially equipped, embodied and/or programmed. The term "magnetic means" is understood to mean in this context, in particular, a means for generating a magnetic field, in particular a permanent magnet in cylindrical form. Preferably, the at least two Hall sensors are arranged in a known two-dimensional spaced disposition, as a consequence of which it is possible to determine the position of the floor in an extremely precise manner. The spaced disposition of the Hall sensors is advantageously between 50% and 100% of a full width at half maximum, (FWHM) of the signal from the sensors.

The term "full width at half maximum" is understood to mean in this context, in particular, a spaced disposition of two positions of a Hall sensor, in which a signal from the Hall sensor corresponds to 50% of a maximum amplitude generated between the positions by means of the magnetic means.

In addition, it is proposed that the floor position detection device comprises an absolute position system and a synchronizing unit that is provided for the purpose of generating the floor signal and for synchronizing a read-out of absolute position data of the absolute position system with the floor signal, as a consequence of which it is possible to determine and check an absolute position of a floor in a rapid and simple manner. The term "absolute position system" is understood to mean in this context an already known system for detecting an absolute position of an elevator car inside an elevator shaft, roughly in accordance with the publication WO 03/011733 A1, in which a functioning method of the absolute position system is described in detail. The term "synchronizing unit" is understood to mean in this context, in particular, an electronic unit for processing substantially digital electrical signals. Preferably, the evaluating unit and the synchronizing unit can be embodied at least partially in one piece. However, it is fundamentally also possible to separate these units.

In an advantageous embodiment, the evaluating unit comprises at least one electronic circuit that is provided for the purpose of comparing amplitudes of analog signals from the at least two Hall sensors and in the case of identical amplitudes changing at least one digital switching state, as a consequence sensing a matching of absolute height level positions of the sensor unit and of the magnetic means in the elevator shaft at a position that characterizes a floor is timed precisely and said matching can be processed in a form that allows further processing in an extremely simple manner. Preferably, the algebraic sign of one of the signals from at least two Hall sensors can be reversed (inverted) by means of the electronic circuit and added to the signal from the second Hall sensor. Established methods for electronically subtracting analog signals are known to a person skilled in the art. As a consequence, an identical signal level from the two Hall sensors can advantageously be converted into a signal level of the magnitude zero, which signal level can be detected in a simpler manner. In particular, by means of a different amplification of the signals from the two Hall sensors in the electronic circuit, it is possible to compensate for an amplitude of the signals which is at a different level as a result of different sensor sensitivities and/or as a result of a different large smallest spaced disposition to the magnetic means, as a consequence of which the accuracy of the floor position detection device can be increased. The amplifications required for compensating the amplitudes can be determined during a training run of the elevator car.

It is further proposed that the sensor unit comprises at least a third Hall sensor and the evaluating unit is provided for the purpose of evaluating at least three floor position characteristics in order to generate the floor signal. By involving a third Hall sensor, it is advantageously possible to exclude erroneous interpretations of the signals from the two other Hall sensors, as a consequence of which the reliability of the floor position detection device is increased in a simple and cost-effective manner. Preferably, the third Hall sensor can be attached in a middle position in relation to the two other Hall sensors, so that any matching of the amplitudes of the signals from the first two Hall sensors with an additional condition that is to be fulfilled simultaneously can be coupled to a minimum amplitude of the third Hall sensor in order to increase the reliability of the floor position detection device. Information from the absolute position system can be used advantageously for the purpose of moving an elevator car into the proximity of a magnetic means at a position that characterizes a floor in order to avoid erroneous interpretations of the signals from the three Hall sensors as a result of stray fields and adjacent field lines of the magnetic means. The term "into the proximity" is understood to mean in this context a closest spaced disposition of the three Hall sensors with regard to the magnetic means, which spaced disposition corresponds to a middle spaced disposition of the two outer lying Hall sensors.

In a further proposed embodiment, the evaluating unit advantageously comprises at least one electronic comparator circuit that is provided for the purpose of digitizing an analog signal from at least one of the at least three Hall sensors, as a consequence of which conditions for the signals from the Hall sensors can be evaluated in a particularly simple manner in an electronic form. Preferably, a minimum value for a positive amplitude of a signal from at least one of the Hall sensors can be defined as a comparator threshold and a maximum value for a negative amplitude of a signal from at least one of the Hall sensors can be defined as a further comparator threshold, as a consequence of which a movement of at least one of the Hall sensors closer to a magnetic means at a position characterizing a floor advantageously can be detected in a particularly simple manner by changing a voltage level at a comparator output. The voltage level of the comparator output can be used advantageously for the purpose of defining proximity situations of the sensor unit to the magnetic means and for the purpose of filtering out in a coincidence circuit any erroneous switching signals that can arise from evaluating the other Hall sensors. The electronic comparator circuit can be embodied with individual comparators or as a window comparator. Established methods for this purpose are known to a person skilled in the art.

It is further proposed that the sensor unit comprises at least a fourth and a fifth Hall sensor and the evaluating unit is provided for the purpose of evaluating at least five floor position characteristics in order to generate the floor signal. By involving a fourth and a fifth Hall sensor, it is possible in an advantageous manner to exclude further possible erroneous interpretations of the signals from the first and from the second Hall sensor, as a consequence of which the reliability of the floor position detection device is further increased in a simple and cost-effective manner. Preferably, the fourth and the fifth Hall sensors are arranged in each case in an outer position of a row of Hall sensors, as a consequence of which it is possible in an advantageous manner to conclude from the signals from these Hall sensors a polarity of a magnetic field generated by a magnetic means at a position characterizing a floor.

In an advantageous embodiment, the synchronizing unit comprises means for determining a timing coincidence of combined and digitized signals from the Hall sensors, as a consequence of which the instant in which a matching of absolute positions of the sensor unit and the magnetic means at a position characterizing a floor is sensed exactly and erroneous interpretations of signals from the Hall sensors can be reliably excluded in a simple and cost-effective manner.

It is proposed that the sensor unit comprises at least two magnetic means that are allocated to a common floor. By using two magnetic means at characterizing positions of the floor, it is possible to increase the reliability of the floor position detection device in a simple and cost-effective manner. Advantageously, the fact that the sensor unit recognizes a first magnetic means can be used as an indication of an elevator car being in the proximity of a floor, as a consequence of which a relatively short travel distance of the elevator car to the second magnetic means of the floor can be determined in a particularly precise manner by involving signals from the Hall sensors, which signals are generated by the second magnetic means.

In an advantageous embodiment, the floor position detection device comprises at least a second sensor unit that functions independently from the first sensor unit in order to generate a redundant floor signal, so that increased reliability with regard to the floor position detection is achieved in a simple and cost-effective manner.

An elevator system having at least one elevator car and having a floor position detection device, wherein at least the first sensor unit is arranged on the elevator car, as a consequence of which a particularly simple and cost-effective solution is achieved together with a particularly small outlay with respect to an installation. However, it would fundamentally also be feasible to provide an arrangement in which a magnetic means is attached at a characterizing position of the elevator car and the at least first sensor unit is attached at a characterizing position of a floor.

DESCRIPTION OF THE DRAWINGS

Further advantages are evident from the following description of the drawings. Exemplary embodiments of the invention are illustrated in the drawings. The description and the claims include numerous features in combination. A person skilled in the art also knows to consider the features individually in an expedient manner and to create further combinations in a purposeful manner. In the drawings:

DETAILED DESCRIPTION

Figure 1:
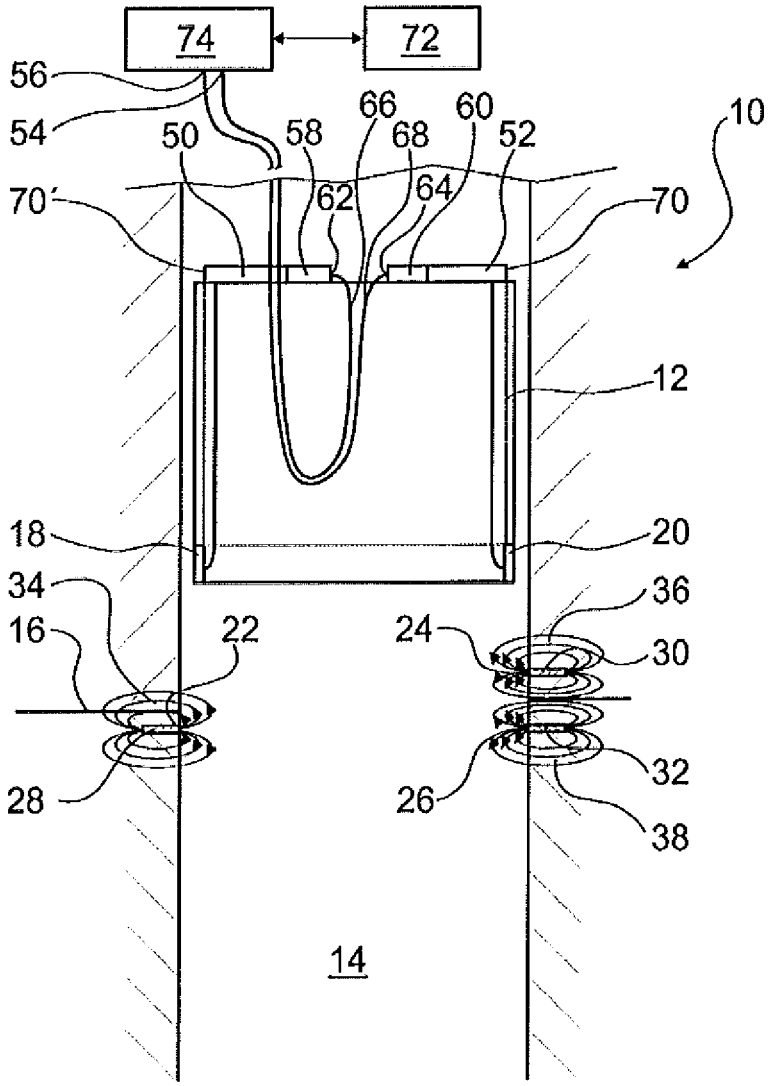
FIG. 1 shows a part of an elevator system with an elevator car in an elevator shaft.

FIG. 1 illustrates a part of an elevator system 10 having an elevator car 12 that can move in an elevator shaft 14. Two sensor units 18, 20 that operate functionally independently from each other are arranged in each case on one of the sides of the elevator car 12, which is located in the proximity of a floor 16, which sensor units are provided for sensing in each case a floor position characteristic. The floor position characteristic is sensed using the first sensor unit 18 by virtue of the fact that a magnetic means 28 is arranged in the elevator shaft 14 at a position 22 that characterizes the floor 16, which magnetic means is embodied as a permanent magnet and whose magnetic field 34 generates electrical signals in the Hall sensors 40, 42, 44, 46, 48 (FIG. 2) during the approach of the first sensor unit 18 that comprises the five Hall sensors 40, 42, 44, 46, 48. It is provided for this purpose that the second sensor unit 20 passes by the two magnetic means 30, 32, which magnetic means are embodied in each case as permanent magnets and are arranged at positions 24, 26 that characterize the floor 16 and generate in each case magnetic fields 36, 38. Each of the sensor units 18, 20 is electrically connected to an evaluating unit 50, 52 respectively, which evaluating unit is provided for the purpose of evaluating five floor position characteristics in each case of a sensor unit 18, 20 in order to generate a floor signal 54, 56.

The second sensor unit 20 that operates independently from the first sensor unit 18 is used for safety reasons in order to generate a redundant floor signal 56.

Each of the two independent evaluating units 50, 52 is electrically connected to a synchronizing unit 58, 60 and arranged in a common housing 70, 70'. The synchronizing units 58, 60 are provided for the purpose of generating the floor signal 54, 56 from the electrical signals from the respective evaluating unit 50, 52 and to synchronize a read-out of absolute position data of an absolute position system 72 with the floor signal 54, 56. For this purpose, a signal cable 66, 68 is routed in each case from an output 62, 64 of the synchronizing units 58, 60 to a control unit 74 that is connected to the absolute position system 72 in such a manner as to be able to transmit data, which absolute position system is not described in detail here and whose details are not illustrated in FIG. 1. The term "control unit" is understood to mean in this context, in particular, a device having an arithmetic-logic unit, a storage unit and an operating program stored in said storage unit. The term "control" is understood to mean in this context a purposeful actuation in an absolute control process and/or also in a closed-loop control process. The control unit 74 is provided for the purpose of testing the floor signals 54, 56 of the synchronizing units 58, 60 as they are received and in the event that the conditions stored in the control unit 74 are fulfilled with regard to a timing match of the two floor signals 54, 56 for reading back the absolute position data of the absolute position system 72 and storing said data in a storage element of the control unit 74.

The exemplary embodiment illustrated in FIG. 1 of a floor position detection device comprises for redundancy reasons two sensor units 18, 20, which operate independently from each other, independent magnetic means 28 and also 30 and 32, two independent evaluating units 50, 52 and two independent synchronizing units 58, 60 in order to generate the floor signals 54, 56. Fundamentally, the floor position detection device can, however, also be configured with one single sensor unit 18 or 20, one magnetic means 28 or 30 and 32, one evaluating unit 50 or 52 and one synchronizing unit 58 or 60 for generating a floor signal 54 or 56, without impairing the idea of the invention.

Figure 2:
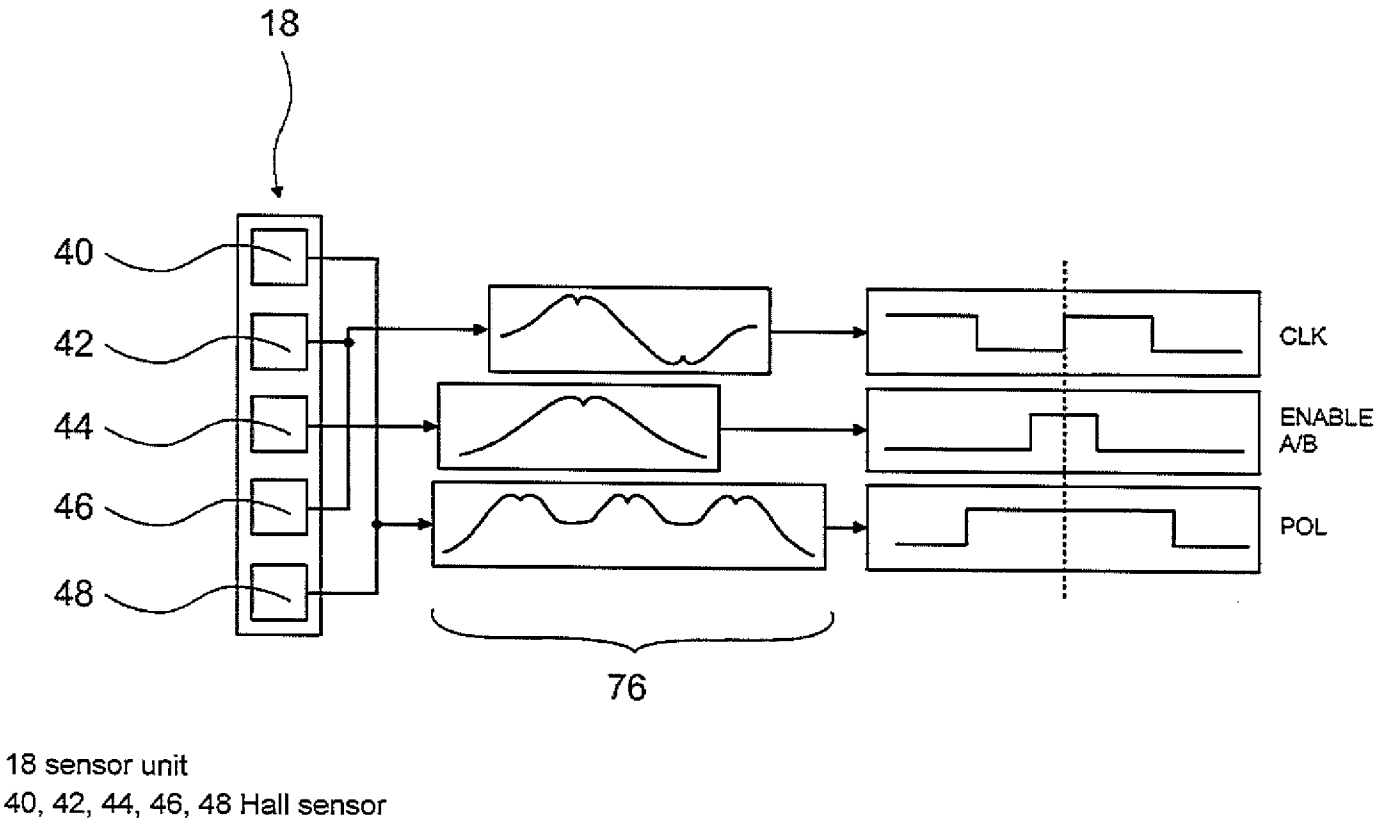
FIG. 2 shows a sensor unit having five Hall sensors and a schematic illustration of a process of evaluating their signals.

FIG. 2 illustrates one of the sensor units 18 from FIG. 1 with five Hall sensors 40, 42, 44, 46 48 and a schematic illustration of an evaluating process. The five Hall sensors 40, 42, 44, 46, 48 are aligned along a straight, perpendicular line at regular spaced dispositions of approximately eight millimeters from sensor middle to sensor middle, so that as they pass by the magnetic means 28 from FIG. 1 in a closest lateral spaced disposition of approximately five millimeters, which magnetic means is arranged at a position 22 that characterizes the floor 16, they sense one after the other a magnetic field 34 generated by the magnetic means 28.

The five Hall sensors 40, 42, 44, 46, 48 are characterized according to a subsequent evaluation of their analog signals 76 in the evaluating unit 50. The two Hall sensors 42 and 46 are the main sensors and are arranged at the second and fourth position of the sensor unit 18. The Hall sensor 44 is described as an enable sensor and is arranged centrally. The Hall sensors 40 and 48 are located on the outer positions of the arrangement of Hall sensors 40, 42, 44, 46, 48 and are characterized together with the Hall sensor 44 as polarity sensors.

The middle part of FIG. 2 shows a schematic illustration of the analog signals 76 from the Hall sensors 40, 42, 44, 46, 48, which signals are combined for evaluation purposes, as said Hall sensors pass by the magnetic means 28 from FIG. 1 at a position 22 that characterizes the floor 16. The analog signals 76 from the five Hall sensors 40, 42, 44, 46, 48 are processed in the electronic circuit of the evaluating unit 50 in accordance with the middle part of FIG. 3. The right-hand part of FIG. 2 illustrates the digital signals CLK, ENABLE A, ENABLE B and POL that are obtained from the combined, analog signals 76 from the five Hall sensors 40, 42, 44, 46, 48 and are supplied to a synchronizing unit 58, which is illustrated in the right-hand part of FIG. 3. An explanation is provided hereinunder as to how the digital signals CLK, ENABLE A, ENABLE B and POL are obtained.

Figure 3:
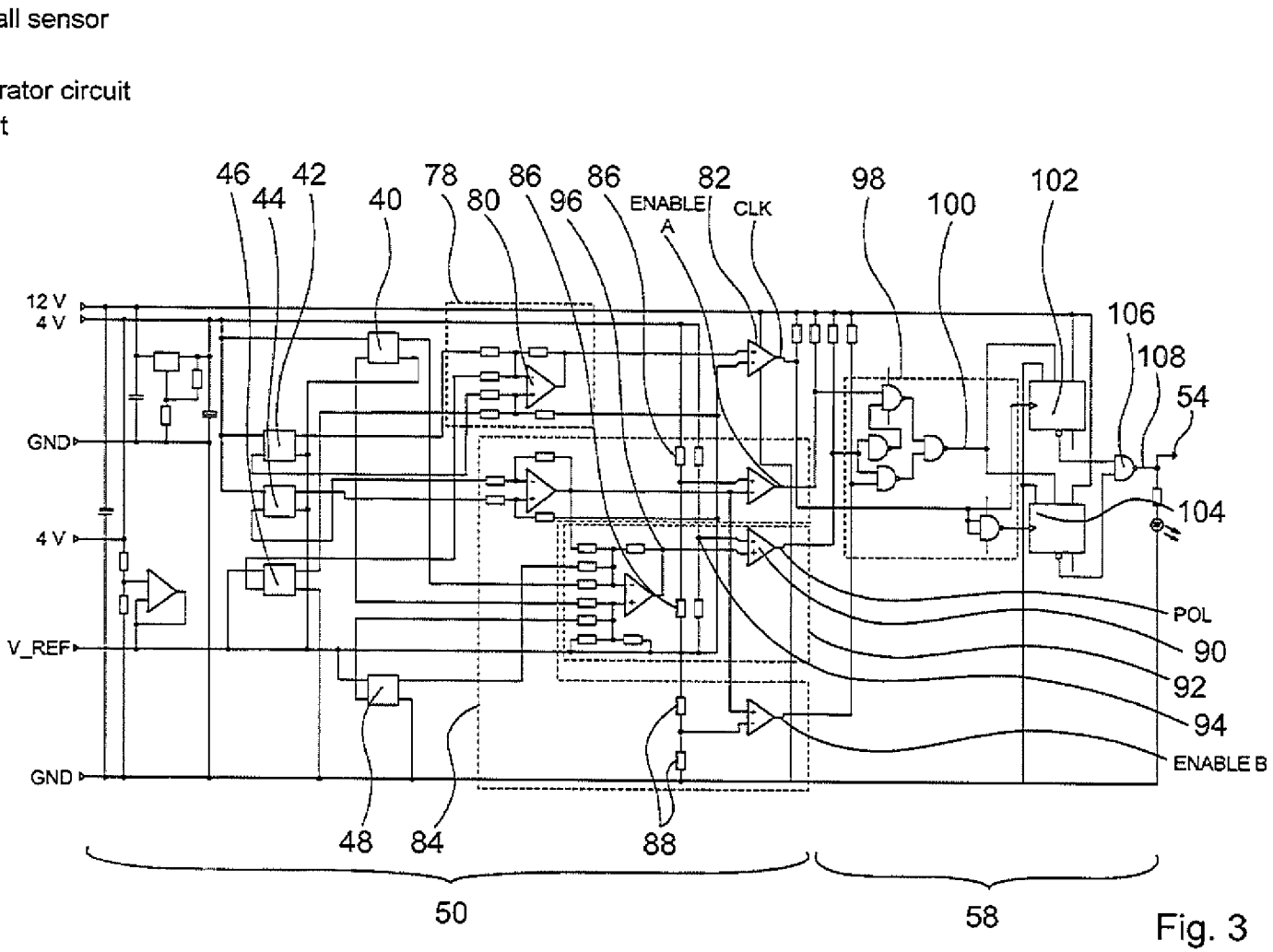
FIG. 3 shows an electronic circuit diagram of an evaluating unit and a synchronizing unit.

The evaluating unit 50 in FIG. 3 comprises an electronic circuit 78 that is provided for the purpose of comparing the amplitudes of the analog signals 76 from the Hall sensors 42 and 46 and in the case of an identical amplitude changing a digital switching state. The signal CLK is generated in that the analog signal 76 from the Hall sensor 46 is subtracted from the analog signal from the Hall sensor 42 in an operational amplifier 80. By adjusting the electrical resistances in a circuit of the operational amplifier 80, the different sensitivities and minimum spaced dispositions between the Hall sensors 42 and 46 and the magnetic means 28 detected during a training run are compensated for. As a consequence, an identical amplitude at the inputs of the operational amplifier 80 corresponds to an identical spaced disposition of the Hall sensors 42 and 46 from the magnetic means 28 that is arranged at a position 22 that characterizes the floor 16. The methods necessary for determining the resistances are known to a person skilled in the art. A zero crossing of a difference in the signals 76 from the Hall sensors 42 and 46 results in a change in an output voltage of the operational amplifier 80. A digital switching state of a further operational amplifier 82 connected downstream in order to generate the signal CLK changes with the level of the output voltage of the operational amplifier 80 relative to a reference voltage V_REF.

In order to generate the digital signals ENABLE A and ENABLE B, the evaluating unit 50 comprises an electronic comparator circuit 84 that is provided for the purpose of digitizing the analog signal 76 from the Hall sensor 44. By means of a resistance circuit 86 of an operational amplifier, the signal ENABLE A="1" is generated if the analog signal 76 from the Hall sensor 44 exceeds a positive voltage threshold of +60 mV. By means of a resistance circuit 88 of a further operational amplifier, the signal ENABLE B="1" is generated if the analog signal 76 from the Hall sensor 44 is below a negative voltage threshold of −60 mV.

A further operational amplifier 90 represents a further comparator circuit 92, which compares a fixedly set reference voltage 94 with an amplitude 96 that is combined from the signals from the Hall sensors 40, 44 and 48 and which changes its digital switching output if the combined amplitude 96 exceeds and/or is below the reference voltage 94. An output voltage of the operational amplifier 90 represents the digital signal POL.

The synchronizing unit 58 comprises a logic circuit 98 of electronic logic modules as means for determining a timing coincidence of the combined and digitized signals from the Hall sensors 40, 42, 44, 46, 48, i.e. of the digital signals CLK, ENABLE A, ENABLE B and POL. An output 100 of this logic circuit 98 is switched to a voltage level logic "1" if ENABLE A is "1" and POL is "0" or if ENABLE B is "1" and POL is "1". This logic condition ensures that the evaluating unit 50 then only reacts if the sensor unit 18 is located in the proximity of the magnetic means 28. The output of the logic circuit 100 is at the reset inputs of two D-flip-flops 102, 104 which react to positive rising edges and whose clock inputs are controlled in each case by the signal CLK and/or the inverted CLK signal. The two inverted data outputs of the D-flip-flops are evaluated in a logic NAND logic element 106, which corresponds to an OR condition to the non-inverted data outputs. In the case of an identical amplitude of the Hall sensors 42 and 46 and in the case of fulfilled logic conditions for the signals ENABLE A, ENABLE B and POL an output 108 of the NAND logic element 106 switches to logic "1" and generates a floor signal 54.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A floor position detection device of an elevator system having a sensor unit with a first Hall sensor for sensing a first floor position characteristic, and having an evaluating unit for evaluating the first floor position characteristic to generate a floor signal, comprising:

a second Hall sensor for sensing a second floor position characteristic; and the evaluating unit evaluating the first and second floor position characteristics to generate the floor signal, the evaluating unit having an electronic circuit for comparing amplitudes of analog signals from the first and second Hall sensors and, in the case of the amplitudes being identical, changing at least one digital switching state.

2. The floor position detection device according to claim 1 including an absolute position system, and a synchronizing unit for generating the floor signal and for synchronizing a read-out of absolute position data of the absolute position system with the floor signal.

3. The floor position detection device according to claim 1 wherein the sensor unit includes a third Hall sensor for sensing a third floor position characteristic and the evaluating unit evaluates the first through third floor position characteristics to generate the floor signal.

4. The floor position detection device according to claim 3 wherein the evaluating unit includes an electronic comparator circuit for digitizing an analog signal from at least one of the first through third Hall sensors.

5. The floor position detection device according to claim 3 including a synchronizing unit having means for determining a timing coincidence of combined and digitized signals from the first through third Hall sensors.

6. The floor position detection device according to claim 3 wherein the sensor unit includes a fourth Hall sensor and a fifth Hall sensor for sensing fourth and fifth floor position characteristics respectively, and the evaluating unit evaluates the first through fifth floor position characteristics to generate the floor signal.

7. The floor position detection device according to claim 6 including a synchronizing unit having means for determining a timing coincidence of combined and digitized signals from the first through fifth Hall sensors.

8. The floor position detection device according to claim 1 wherein the sensor unit includes at least two magnetic means that are allocated to a common floor.

9. The floor position detection device according to claim 1 including another sensor unit that functions independently from the sensor unit with the first Hall sensor to generate a redundant floor signal.

10. An elevator system having an elevator car and a floor position detection device comprising:

a sensor unit with a first Hall sensor for sensing a first floor position characteristic and a second Hall sensor for sensing a second floor position characteristic, the sensor unit being arranged on the elevator car; and an evaluating unit for evaluating the first and second floor position characteristics to generate a floor signal, the evaluating unit having an electronic circuit for comparing amplitudes of analog signals from the first and second Hall sensors and, in the case of the amplitudes being identical, changing at least one digital switching state.

11. A method for detecting the position of a floor in an elevator system comprising the steps of:

providing a sensor unit with a first Hall sensor for sensing a first floor position characteristic and a second Hall sensor for sensing a second floor position characteristic;

operating the sensor unit to sense the first floor position characteristic of a floor and to sense the second floor position characteristic of the floor;

providing an evaluating unit for evaluating the first and second floor position characteristics to generate a floor signal, the evaluating unit having an electronic circuit for comparing amplitudes of analog signals from the first and second Hall sensors and, in the case of the amplitudes being identical, changing at least one digital switching state; and operating the evaluating unit to generate the floor signal.

12. The method according to claim 11 wherein the floor signal initiates an absolute position being provided by an absolute position system to a control unit.

* * * * *